US005183117A

United States Patent [19]

Strickland

[11] Patent Number: 5,183,117

[45] Date of Patent: Feb. 2, 1993

[54] FIRE EXTINGUISHER

[76] Inventor: Edward Strickland, 4600 Nana Pl., Kaneohe, Hi. 96744

[21] Appl. No.: 723,374

[22] Filed: Jun. 28, 1991

[51] Int. Cl.[5] ..... A62C 3/06

[52] U.S. Cl. ..... 169/46; 169/28; 169/47; 169/49; 169/51; 169/52; 169/69; 169/70

[58] Field of Search ..... 169/69, 28, 35, 43, 169/44, 46, 47, 48, 49, 51, 52, 70, 91

[56] References Cited

U.S. PATENT DOCUMENTS

| | | | |
|---|---|---|---|
| 739,377 | 9/1903 | Bell | 169/69 X |
| 870,479 | 11/1907 | Stanley | 169/28 X |
| 1,080,068 | 12/1913 | Breche | 169/35 |
| 1,520,288 | 12/1924 | Featherstone | 169/69 X |
| 3,033,291 | 5/1962 | Wieslander | 169/35 X |
| 3,070,172 | 12/1962 | Carter, Jr. | 169/69 X |
| 3,463,227 | 8/1969 | Smith | 169/69 X |
| 3,685,584 | 8/1972 | Gracia | 169/69 X |
| 4,433,733 | 2/1984 | Cunningham | 169/69 X |

FOREIGN PATENT DOCUMENTS

| | | | |
|---|---|---|---|
| 1062534 | 3/1967 | United Kingdom | 169/69 |
| 2085296 | 4/1982 | United Kingdom | 169/69 |

*Primary Examiner*—Charles A. Marmor
*Assistant Examiner*—Andrew C. Pike
*Attorney, Agent, or Firm*—Shlesinger, Arkwright & Garvey

[57] ABSTRACT

The method and apparatus of this invention provides a cannon-like device for projecting a sheath of fire extinguishing particles rapidly upwardly along a flaming oil and/or gas stream gushing up from an oil and/or gas well. The sheath instantaneously insulates the oil and/or gas in the stream from the surrounding atmosphere to freeze the flame at the tip of the sheath and shield the stream within the sheath from contact with the flaming oil and/or gas above and around the stream of oil and/or gas enclosed within the sheath until all of the already flaming oil and/or gas has been burned out. The method for eliminating the flames above the outlet of an oil well is accomplished by separating the oil and/or gas stream flowing from the oil and/or gas well from the flames by producing a sheath of fire extinguishing material, driven by an explosive charge into a position to surround and separate the oil and/or gas stream from the flames.

31 Claims, 7 Drawing Sheets

FIRE EXTINGUISHER

FIELD OF THE INVENTION

This invention relates to a fire extinguishing apparatus and method and more particularly to an apparatus and method for extinguishing oil and gas well fires.

BACKGROUND OF THE INVENTION

Occasionally destructive fires erupt when oil and/or gas are allowed to flow freely from their wellheads and either accidentally or as has happened in Kuwait, these oil and/or gas flows are intentionally set on fire. In the past it has been possible in some instances to extinguish such fires by lowering a drum, loaded with as much as 400 lbs. of a detonating explosive charge into the stream jetting from the wellhead and exploding the charge in the flame. The shock wave resulting from the tremendous explosion violently blasts everything near the center of the explosion and often times the fire is snuffed out. However, this procedure is only successful on smaller types of fires.

Other attempts have been made to extinguish such fires by injecting water or carbon dioxide, or other fire extinguishing chemicals either into the entire body of flames or into the oil well casing near the outlet end of the oil well to produce a non-combustible mixture together with the oil and/or gas flowing under pressure from the wellhead or in an attempt to dilute the fuel and/or cool the fuel in the burning oil and/or gas stream to a temperature below its autoignition temperature. Such procedures are based on the principle of putting out the fire at the wellhead by in effect diluting the flow of the oil and/or gas fuel to the flames to a degree to make the entire mixture incombustible.

Examples of certain of these systems are described in the following issued United States patents:

| | | |
|---|---|---|
| 703,832 | Rigby | July 1, 1902 |
| 1,640,839 | Kliewer | August 40, 1927 |
| 3,070,172 | Carter, Jr. | December 25, 1962 |
| 3,463,227 | Smith | August 26, 1969 |
| 3,620,299 | Wiseman, Jr. | November 16, 1971 |
| 3,685,584 | Gracia | August 22, 1972 |
| 3,763,936 | Menage | October 9, 1973 |
| 4,316,506 | Poole | February 23, 1982 |
| 4,899,827 | Poole | February 13, 1990 |

It is well known that high explosives have been used adjacent to and within the flames at the wellheads of the flaming oil and/or gas wells in an attempt to snuff out the flame. As is evident from the continuing disaster in Kuwait, when the size of the flame becomes too large, this procedure is no longer satisfactory. In fact according to news reports from that area, only a small number of the less vigorous flames at these well heads have been extinguished to date.

A variation of this explosive extinguishing technique is shown in the U.S. Pat. No. 3,070,172. This patent contains a description of a method for attacking oil well fires and the like by use of a bomb like container filled with a fire extinguishing material such as $CO_2$ under pressure which explodes when the bomb is heated by the flames. The violence of the explosion is alleged to be effective to suppress the fire and the rapid exhaustion of the gaseous material that is released from within the bomb causes a chilling of this flame in an attempt to suppress the flame. Further, the non-flammable $CO_2$ gas itself assists in smothering the flame. It is doubtful however that a sufficiently large $CO_2$ bomb could be prepared and used successfully against large oil and/or gas well blazes that would be more powerful than the currently used 400 lbs. or larger detonating explosive charges used in the pure explosive charge procedure; in either case great dangers are encountered.

The group of U.S. Pat. Nos. 1,640,839; 3,463,227; 3,763,936; 4,316,506 and 4,899,827 all show examples of apparatuses designed to mix a fire extinguishing material in the flow of the oil and/or gas gushing from a wellhead that is burning in an uncontrolled flame above the wellhead. In these teachings it is variously proposed to provide an apparatus that is built into the wellhead or outlet from the well, which apparatus is particularly adapted to inject either water, steam, liquid and gaseous $CO_2$ and mono-potassium phosphate mixture, nitrogen, monoammonia phosphate, and possibly other known fire extinguishing chemicals or mixtures thereof directly into the oil and/or gas stream issuing from the well. In all of these patents the use of an apparatus is required that includes a structure built into the wellhead piping arrangement that can be used should the necessity arise for introducing a fire extinguishing substance into the flowing stream to be mixed with the oil and/or gas, so that as stated in U.S. Pat. No. 3,763,936 col. 2, lines 1-5, "a turbulent zone is created artificially across the whole of the mixture of fuel and extinguishing fluid upstream of the flame and downstream of the zone in which the extinguishing fluid is injected, to give a homogeneous mixture at the base of the flame."

Other fire extinguishing apparatuses built into a wellhead or surrounding the head are shown in U.S. Pat. Nos. 703,832 and 3,620,299 wherein a stream of steam and $CO_2$ respectively are driven under pressure into contact with a gushing stream of oil and/or gas. The earlier patent includes a valve structure adapted to be closed to shut off an oil flow and incidentally includes a bare description of a means for discharging steam "therefrom for extinguishing the flames when from any cause the oil or gas flowing from the well becomes ignited." See page 1, lines 15 to 18. The later patent shows means for injecting a fire extinguishing material into the well casing and for surrounding a gushing oil well flow with means for dispensing liquid $CO_2$ from several manifolds installed around the wellhead to displace oxygen in the surrounding atmosphere and wherein the "extinguishing fluid is injected into the well casing to be mixed with gas and oil as they are being blown from the well". See Col. 1, lines 56 to 58.

Another fire extinguishing apparatus adapted only for use in connection with oil and gas wells drilled in water covered areas is shown in U.S. Pat. No. 3,685,584. This patent describes a water spraying means that produces a dome-shaped curtain of water that is directed to cover the entire oil well platform and drilling rig on the platform. The water is sprayed from nozzles supported on a pair of arcuate float structures that can be moved into position and bolted together to surround the platform and produce a circular or other shape water curtain over the entire oil well platform structure. It is said that this continuously formed curtain or water shield will aid in cutting off the supply of oxygen and extinguish the flame.

BRIEF DESCRIPTION OF THIS INVENTION

The present invention as distinguished from devices built into the wellhead structure provides a portable apparatus in the form of a cannon-like device and a method for firing a fire extinguishing chemical that does not attempt to extinguish a fire by forming a homogeneous mixture of the fire extinguishing material with the gushing oil and/or gas stream but is adapted to form a cylindrical sheath that surrounds the stream at the outlet from the well to extinguish the flame at the wellhead of a flaming oil and/or gas well. The major difference between my invention and most previous methods is that the prior art requires an enormous amount of extinguisher material since they are directed to the entire body of flame and the entire body of gas and oil whereas in my invention it is necessary to merely extinguish the small volume of flame in the immediate vicinity of the jetting fuel. This procedure is instantaneously effective to freeze and smother the flame trapped within the sheath body issuing from the wellhead, such as at the multiplicity of wells currently flaming away in Kuwait. The upwardly and outwardly expanded cylindrical sheath is exploded into a position that completely envelopes the jetting fuel which feeds the flaming stream thereby extinguishing the fire within the sheath while cutting off the flow of fuel to the huge body of fire which surrounds the outside of the sheath. The sheath travels rapidly along the outside of the gushing stream of oil and/or gas to simultaneously insulate the upwardly flowing stream from exposure to the ambient air surrounding the fire zone, and also the elements in the sheath extract heat from the fire which surrounds the flowing stream whereby to cool and maintain the temperature within the sheath body surrounding the upwardly flowing jet stream at a temperature that is below the autoignition temperature.

These desired effects are accomplished by surrounding the wellhead jet with a concentrically disposed cannon-like device that supports a multiplicity of closely spaced together, generally vertically disposed bore chambers that are each filled with an explosive charge positioned behind the charges of non-combustible materials that when all are fired off form the sheath. The explosive charges disposed in a number of such chambers that are positioned in at least one circular pattern of the chambers that surround the well's outlet are all fired simultaneously to produce an upwardly flowing dense cylindrical body or sheath of the non-combustible material that forms the desired sheath which in less than a fraction of a second in time expands to completely surround the entire length of the oil and/or gas jet.

This sheath of dense fire extinguishing material surrounds the oil and/or gas stream and expands outwardly around the path of the flowing oil and/or gas stream after it issues from the wellhead. The mass of the preferably finely divided fire extinguishing particles and the gas generated therefrom forms the sheath that completely surrounds the flowing jet stream to freeze the flame within the sheath, to insulate the enclosed jet stream from the ambient atmosphere to seal it from exposure to the oxygen in the ambient atmosphere whereby to smother the flame and to block all further feeding of fuel to the huge surrounding body of fire. In addition, in this preferred form of the invention the particulate substance that is in substantially intimate contact with the periphery of the upwardly flowing oil stream and the gas entrained therewith is selected to be a material which, when it is heated by the contents of the stream, cools the upwardly flowing jet stream that is contained within the sheath, to cool it to a temperature that is below its autoignition temperature.

In a most preferred practice of the method of this invention of extinguishing oil and gas well fires, the material is selected to be one that is so finely divided that it almost instantly absorbs heat from within the sheath surrounding the flowing oil and gas stream. This finely divided material additionally is made from a material which not only absorbs heat by surface exposure, but is one wherein the absorbed heat energizes a chemical reaction to produce a gaseous material further to cool and to smother the fires within the sheath that surround the periphery of the flowing stream. The preferred material which not only utilizes heat energy to promote its decomposition is also selected to be one that incidentally is decomposed to produce an expanding non-combustible gaseous component that subsequently serves as the sheath itself to insulate the combustible oil and gas within the sheath from the surrounding huge body of fire, effectively shutting off the fuel to said huge body of fire which is normally fully extinguished in less than ½ second thereafter.

The explosive containing chamber means of the cannon-like apparatus that is adapted to fire the finely divided fire extinguishing material into a coaxial cylindrical position surrounding the stream of oil and/or gas feeding the flaming discharge from the wellhead can preferably be designed in the form of a plurality of individual, closely spaced together generally upwardly and downwardly extending chambers or bores each containing an explosive charge preferably positioned between two equal charges of the finely divided fire extinguishing material. These chambers are supported in a suitable portable means to be moved into a position to be substantially concentrically positioned around a wellhead spewing forth the flaming oil and gas stream wherein the chambers can all be fired off simultaneously to throw certain of the fire extinguishing finely divided charges outwardly in one direction to flow concentrically around the gushing oil and/or gas stream while a corresponding number of the same charges are fired in an opposite direction whereby to produce substantially balanced action and reaction forces within the chambers and to put out fires below the cannon device.

The outwardly fired finely divided material is instantaneously positioned around the flaming oil and gas stream to form a dense moving sheath that completely surrounds the stream, and as the nearly instantaneous build up of the sheath progresses, a growing three dimensional wall or impervious barrier is established between the freshly gushing oil and gas stream and the surrounding fire that otherwise would be fed by the gushing oil and gas, which barrier is so dense as to be effectively impervious to the atmosphere surrounding the stream and as noted above thus serves to cut off the flow of the combustible oil and/or gas fuel which feeds the surrounding fires. The dense mass of particulate material thus expands into a gaseous sheath at least 500 times more voluminous and thus provides an impervious sheath that simultaneously insulates the stream from exposure to the oxygen in the atmosphere and for a fraction of a second fully shuts off the fully enclosed fresh oil and/or gas jet gushing from the well from supplying any fuel whatsoever to the surrounding massive body of fire. It is well known that no matter how fast a valve to a gas-fed flame is flipped off and back on, once the flame is put out it will not relight without being deliberately reignited.

The explosively driven minutely divided charges of fire extinguishing material move outwardly from the muzzles of their chambers and merge together around the stream to form a dense sheath, almost instantaneously, which sheath completely insulates that stream from contact with the surrounding atmosphere and cuts off all possibility of any of the freshly flowing oil and/or gas stream from becoming a part of the surrounding body of fire. The individual particles of the finely divided material in this sheath that are exposed to the heat of the flaming oil and gas within the sheath are heated by absorbing the thermal energy of the flame substantially to reduce the flames and thus tend to cool the flowing oil and gas to a temperature below their autoignition temperatures. When the preferred fire extinguishing material is used, the flame's energy is further utilized to promote a chemical reaction that decomposes the extinguishing material into other chemical constituents that expand the sheath outwardly while simultaneously producing another non-combustible type of fire extinguishing material that further expands the body into a functional sheath.

IN THE DRAWINGS

Figure 5:
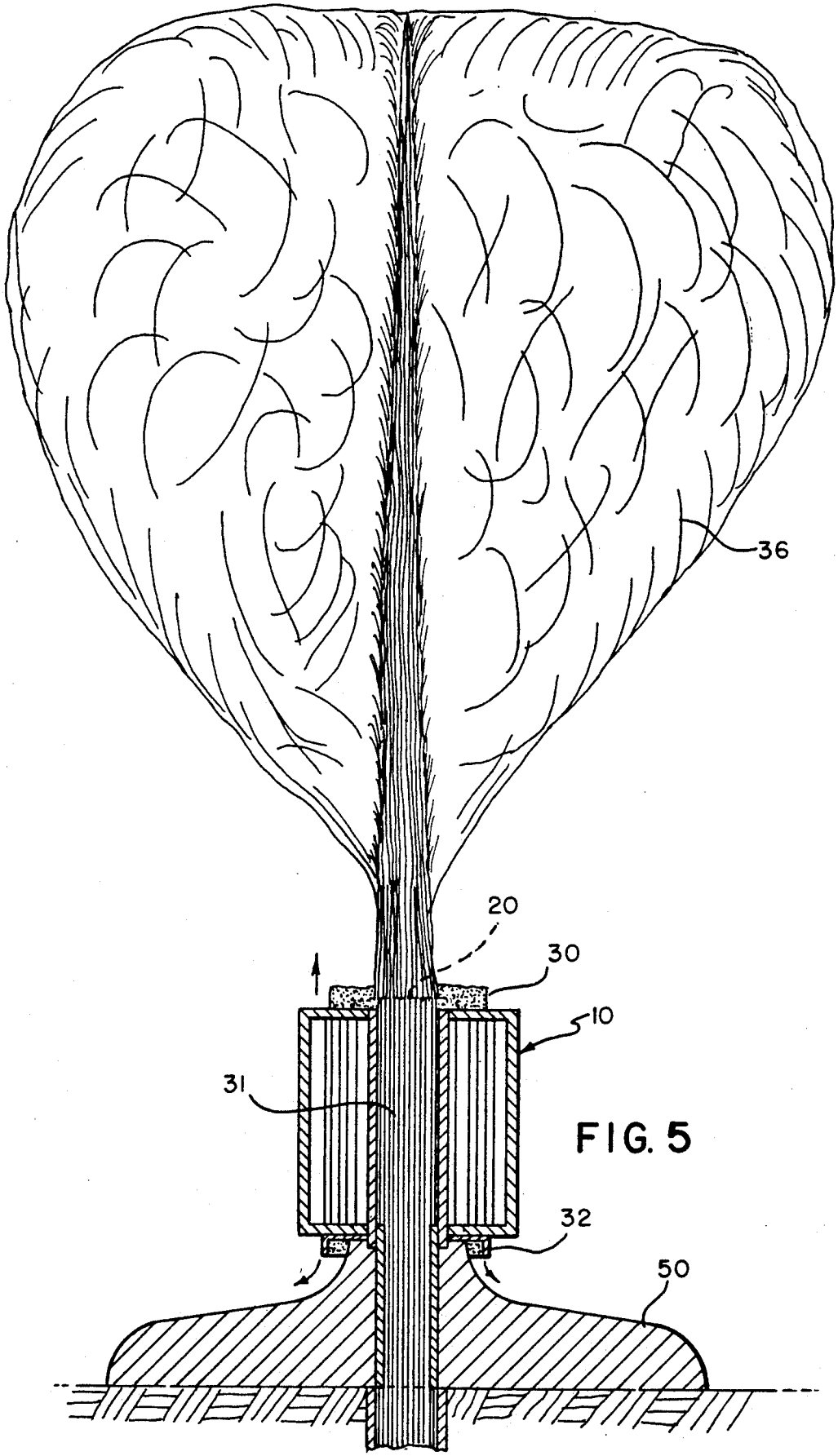
Figure 6:
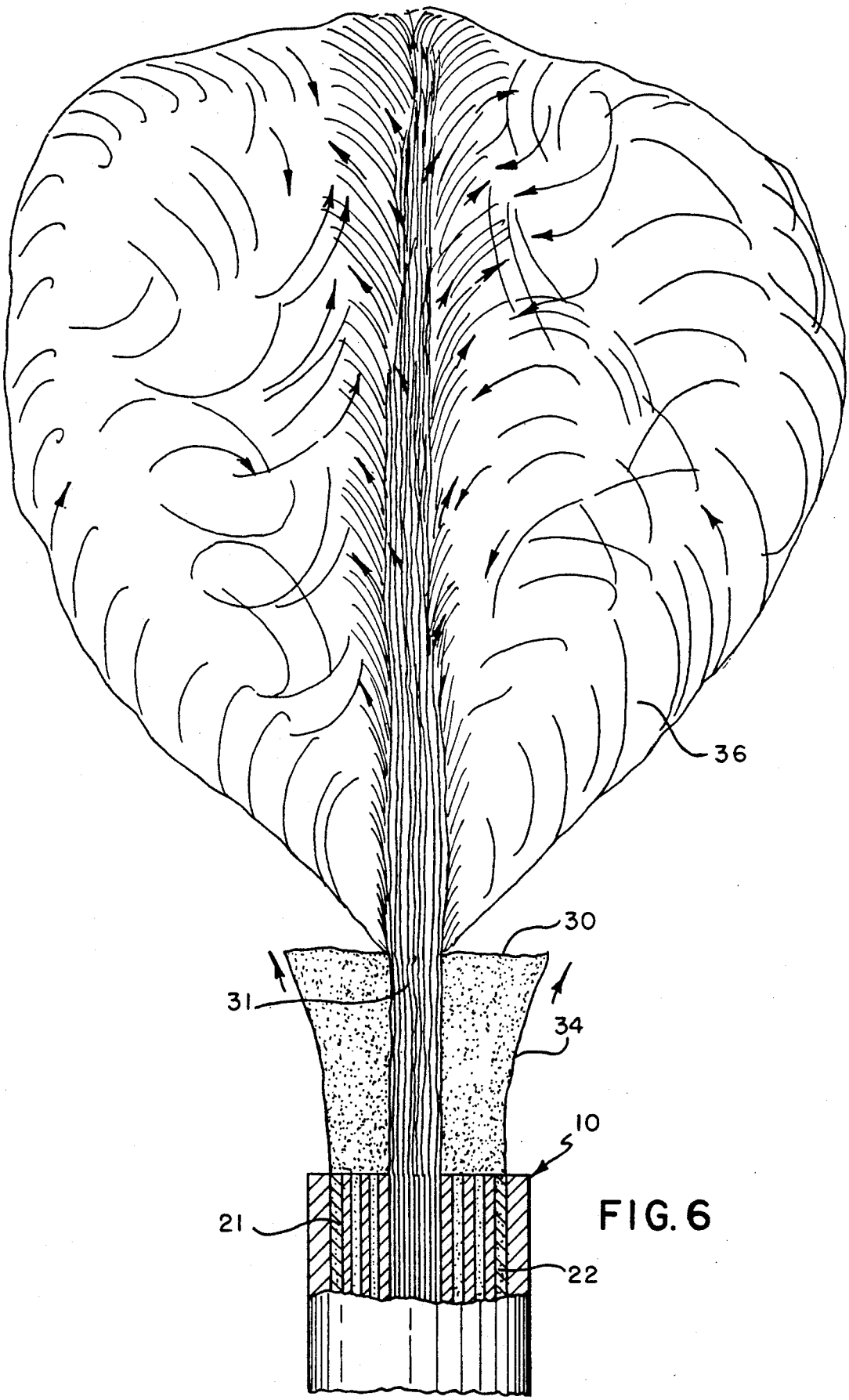
Figure 7:
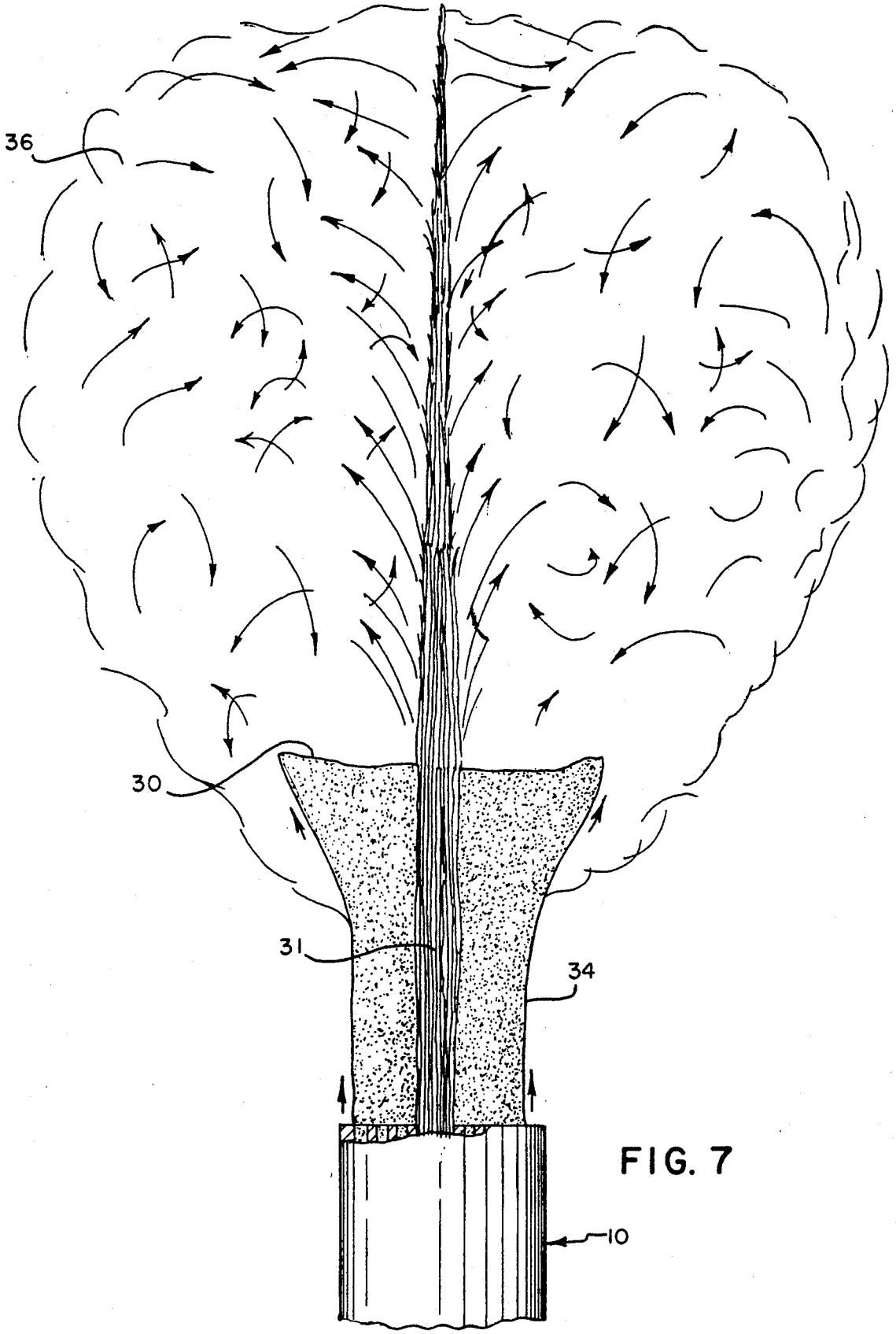
Figure 8:
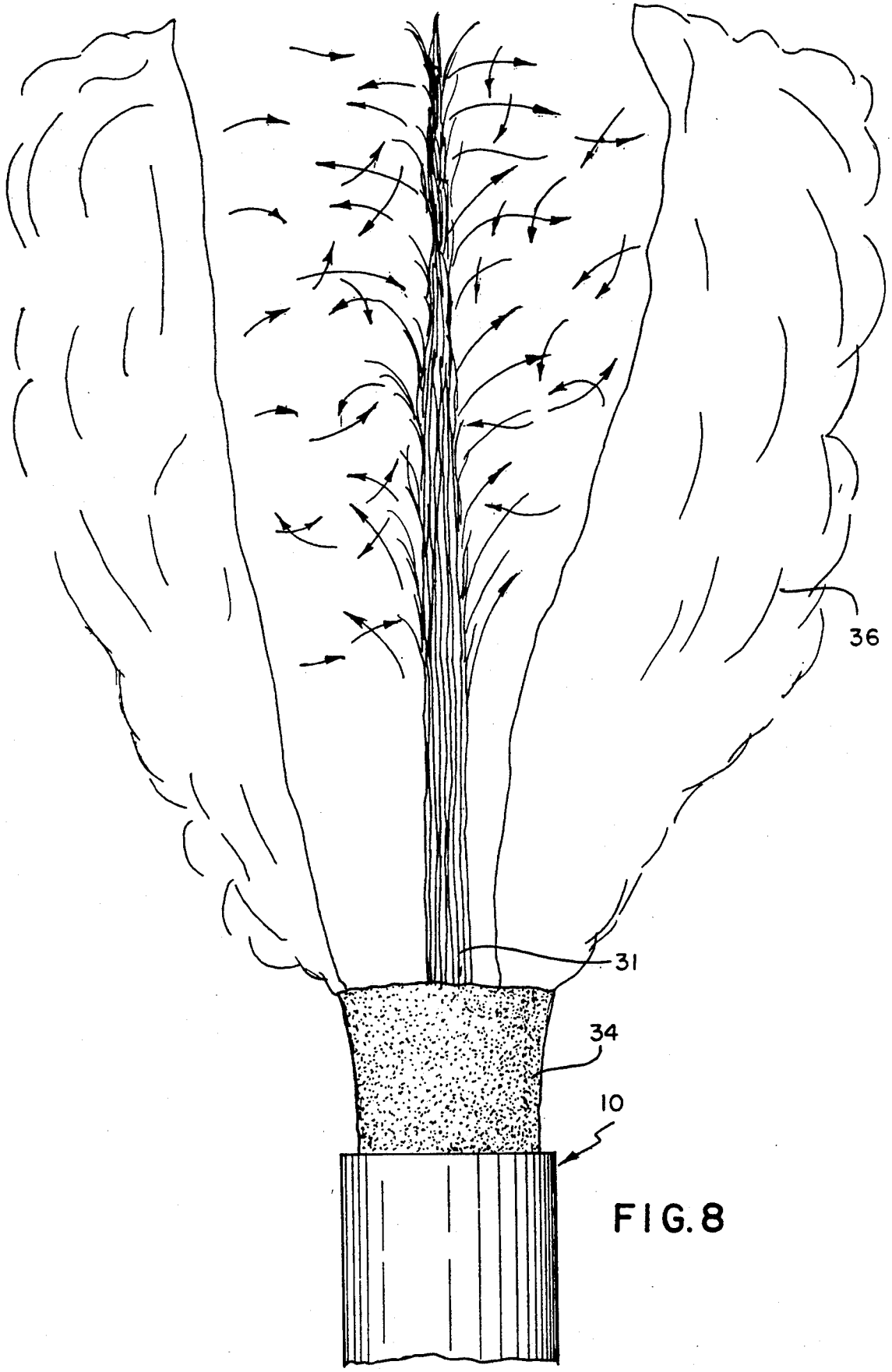

FIG. 5 is a vertical section that shows the sheath 30 produced by this device one-one thousandths of a second after the explosive charges in all of the cannon means have been fired simultaneously and the fire extinguishing material is beginning to move in opposite directions upwardly, and downwardly, there being a deflector underneath the downwardly facing muzzles of the concentrically disposed chambers;

FIG. 6 is a partially sectional side elevation of the upper end of the cannon of FIG. 5 at about four-one thousandths of a second after all of the explosive charges in certain of the circular rows of chambers have been fired;

FIG. 7 shows the development of the expanding sheath shown in FIG. 6 after about seven-one thousandths of a second as the upwardly moving charges of the fire extinguishing material flow along the side of the oil and/or gas stream; and, FIG. 8 is partly broken away and shows the ultimate development of the upwardly growing sheath that has now capped the freshly flowing oil and gas stream separated from the about to expire mass of burning oil and/or gas that surrounds the outside of the sheath.

DETAILED DESCRIPTION

The apparatus of this invention that is used for extinguishing oil and gas well fires preferably makes use of a finely divided fire extinguishing material. The apparatus, which I characteristically call a cannon, contains explosive charges for producing the fire extinguishing sheath of this invention that surrounds the flowing stream of oil and/or gas, this cannon device includes a body generally indicated by the reference number 10, which body is made in sections that are hinged together so that the body may be opened up and moved into position at the top of the flaming well and then closed around the wellhead. The sections of the body include a larger arcuate element 12 that is provided with an appendage 14 that is designed to cooperate with means attached to any convenient mobile apparatus adapted to move bulky objects over the terrain surrounding the wellhead. Two smaller arcuate body elements 16 and 18 are hingedly supported on the opposite ends of the larger body element 12 and are adapted to be opened as shown in FIG. 3 so that the apparatus can be moved into position and removed from around the outwardly extending top 20 of a flaming wellhead. Any suitable conveyance that can lift and move this assembly such as a forklift machine can be used to engage the coupling appendage 14 to move the body 10 into position or away from the wellhead 20. Suitable opening and closing means not shown which may be remotely controlled and power driven may be provided for opening and closing the hinged body sections 16 and 18 to move them to and from the positions shown in FIGS. 2 and 3.

The body elements 12, 16, and 18 are selected to be of a size to form an annular collar adapted to be positioned in a substantially concentric position around the wellhead 20 with a convenient spacing, which is not critical, between the inner wall of the annular body 10 and the outer surface of the outlet from the well. The diameter of the annular opening at the center of the assembly may be selected to position the inner wall of the cannon near the outer periphery of the flow from the wellhead and the outer wall of the body is designed to merely surround and contain the several concentric rows 21 and 22 of the removable chambers, one to which chamber is shown in FIG. 4.

Each one of the body sections 12, 16 and 18 is provided with a multiplicity of these rows of removable chambers 21 and 22 or elements constituting bore holes that are arranged to form the circular patterns 21 and 22, each of the bore holes being about equally spaced one from another and which extend from the top of the body to its bottom. One of such chambers making up the rows 21 and 22 is shown in FIG. 4. These chambers have fairly thick walls adapted to contain the force of explosive charge and are sized to be closely spaced together and, as seen in the plan view of FIG. 2, the muzzles of the chambers in the circle 21 are placed in a manner, looking in a horizontal radial direction, to be in a position that substantially overlaps or covers one of the spaces between each of the chambers that form the circular pattern 22.

Figure 4:
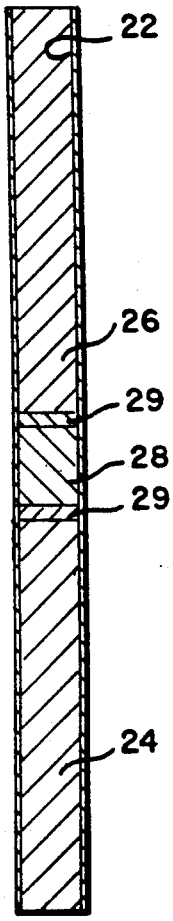
FIG. 4 is a sectional side elevation taken on line 4—4 of one of the cannon's chambers of FIG. 1 showing it loaded with an explosive charge and two charges of fire extinguishing material.

Each chamber as shown in FIG. 4 is preferably filled first with one of the two charges 24 or 26 of fire extinguishing material in either the top or bottom portion of the chamber and then a suitable deflagration explosive charge 28 is placed in the center of the chamber with plugs 29 on its opposite sides. Then the other of the charges of the fire extinguishing material can be packed into its respective end of that chamber. The charged and armed chambers may be filled and may be stored for future use in any convenient place for ready assembly in their respective arcuate sections 12, and 16 and 18 of an annular cannon device.

Conventional means not shown are built into this apparatus to fire all of the explosive charges assembled in the several concentric rings of the chambers either in unison or in a predetermined sequences of the rings 21 and 22. While the drawings illustrate a body having two concentric rows of chambers, three or more rows of similar chambers of any desired size may be provided in a cannon device adapted for use with fires at the larger well holes. The explosive charges are all rigged to have at least all of charges in one of the circular rows of the charged chambers fired simultaneously or, as with the smaller sized cannons shown in FIG. 2, the two rows of the charged chambers 21 and 22 can be and usually are all fired off together.

When fires at the larger wells must be put out, a cannon may be provided with three or more separate concentric rows of charged bores that may be assembled in the cannon device which may be advantageously fired off sequentially in an order to prolong the issuance of the fire extinguishing material possibly in a quick succession to increase the duration and to elongate the sheath that results as will appear more fully below.

Figure 2:
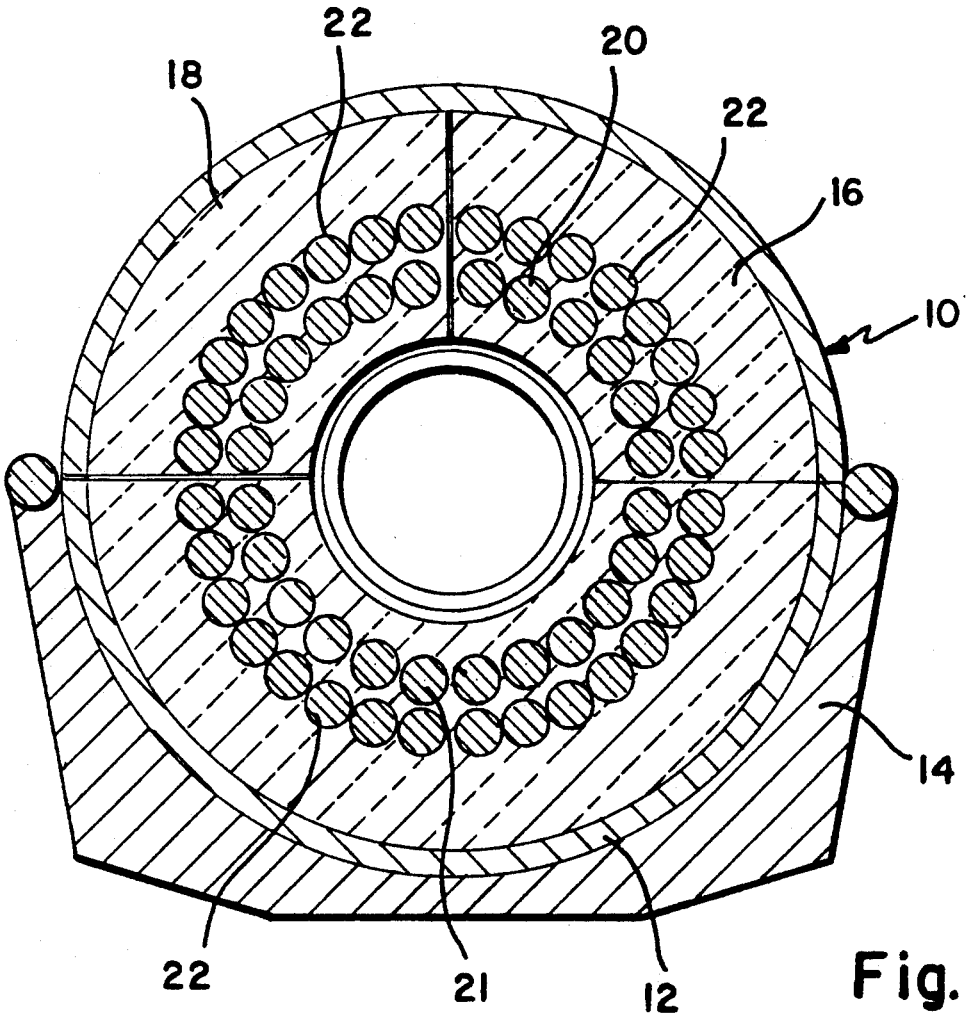
FIG. 2 is a top plan view of a preferred form of the apparatus shown in FIG. 1.
Figure 3:
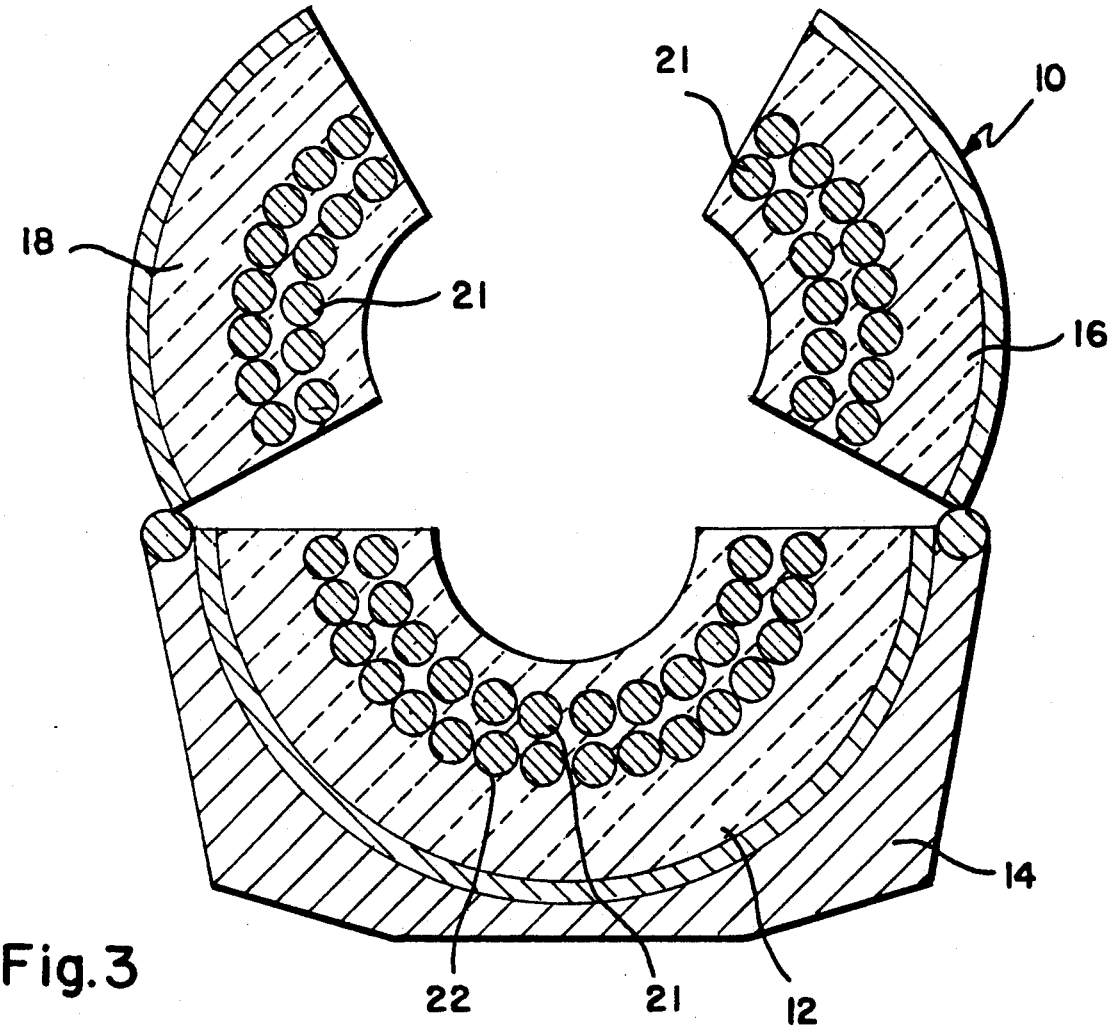
FIG. 3 is a top plan view of the apparatus of FIG. 2 shown with its elements in an opened positioned to permit it to be moved into its desired concentric position around a wellhead.

When the above described annular cannon device has been placed in position and the elements 16 and 18 have been closed as shown in FIG. 2 to surround the upwardly flowing oil and/or gas stream issuing from a flaming well which typically may have internal temperatures of 200° F., preferably spaced about 3' above the ground level on legs not shown or on a deflector 50 as shown in FIG. 5, and the surrounding terrain has been properly prepared, the explosive charges 28 in all of the chambers in at least one complete ring of the chambers 21 or 22 or in all of the chambers in both of the circular patterns are fired simultaneously. The simultaneous discharge of the fire extinguishing charges from the chambers in the respective circles in this pattern projects the extinguishing material from the muzzles of the chambers which are designed to propel the particulate charges outwardly at about 1000 feet per second to surround the generally upwardly flowing oil and/or gas stream with a dense cloud to produce a rapidly growing sheath that is impervious to the surrounding atmosphere and which sheath completely isolates the flaming stream flowing out of the wellhead to freeze the fire and effectively cut off the combustible fuel supply to the body of fire burning around above and below the sheath at the outlet from the well.

The explosive charges are preferably designed to produce a velocity in this moving cylindrical stream of fire extinguishing material forming the transient sheath as the material is projected from the muzzle of the chambers that is faster than the velocity of the outwardly moving stream of oil and gas, and preferably the fire extinguishing material is projected at a velocity considerably faster than that of the enclosed moving stream. As the charges of the extinguishing material issue simultaneously from the muzzles of each of the chambers, for example, from the top of the bores of all of the chambers 21 and 22, they instantaneously form a growing cylindrical sheath of the incombustible fire extinguishing material having an adequate density to produce the desired property of being impervious to air and also has an effective heat absorption density, which sheath completely surrounds the flowing oil and/or gas stream as shown in the sequence of FIGS. 6, 7, and 8.

As the upper tip end 30 of this sheath shown in FIG. 5 begins to move along the periphery of the oil and gas stream 31, the remaining fire extinguishing material in the individual charges issuing subsequently from the several individual muzzles merges together to complete a cylindrical wall of the substantially fully atomized fire extinguishing material around the flowing stream, which wall moves upwardly with and expands somewhat sideways, at right angles to the center line of the stream of the burning oil and gas, to ultimately form the continuous thick and dense sheath shown in FIG. 8. This sheath that is traveling rapidly along the slower moving stream of oil and/or gas is non-combustible and is so dense as to prevent oxygen from the ambient atmosphere that surrounds the flowing stream from reaching the enclosed stream and effectively prevents any combustible fuel in the stream from reaching the massive fireball that surround the sheath, in order to substantially instantaneously freeze or snuff out the flame within the sheath and deny the flame outside of the sheath any additional fuel. The sheath expands sidewise as it moves upwardly along said oil and gas stream and the tip end 30 expands inwardly and grows to form a cap on said stream that separates the flame from contact with the stream. A downwardly moving tip end 32 of a sheath issues from the bottom side of the body 10 as shown in FIG. 5.

The charges 24 and 26 of the fire extinguishing material that are explosively discharged from the chambers initially move outwardly around the well pipe 20 and expand to form a coherent sheath 34 that is so dense as to be impervious to the flow of oxygen from the surrounding air to the flowing stream of oil and/or gas. The tip of this sheath moves rapidly to the outward end of the oil well outlet as shown in FIG. 5 and comes into peripheral contact with the flowing oil and gas stream 31. When the tip touches the flaming stream, it freezes the flame and the fire extinguishing material that follows this tip end surrounds the stream to form the sheath illustrated in FIGS. 6 through 8 that precludes the movement of oxygen from the ambient air into contact with the flowing stream and effectively forms a barrier between the fuel 31 within the sheath and the surrounding huge body of fire. As the sheath continues to grow along the stream and outwardly the fire extinguishing material takes heat from the stream within the sheath and simultaneously begins to expand slightly at right angles from the centerline of the flow pattern of the stream, the flame is extinguished instantly inside the sheath immediately upon the contacting of the tip end of the sheath with the periphery of the oil and/or gas in the flaming stream. The flaming oil and gas that has previously issued from the well just before the cannon was fired ride outwardly and over the top of the tip of the sheath to flow around its outside as the sheath continues to build up as shown in the series of stages illustrated in FIGS. 6, 7, and 8 until this already flaming mass of oil and gas outside of the sheath burns itself out.

It is known that the poorly aerated flame of a burning oil or gas well burns at a lower temperature of about 2200° F. Therefore, the sheath of the dense non-combustible fire extinguishing material that surrounds such a flaming stream can easily cool and smother and thus extinguish this flame. Once the flame has been initially and instantaneously doused within the sheath, even though the oil and gas stream continues to flow from the top of the well into the growing sheath, the flame is killed, unless of course any escaping flammable material is subsequently reignited by an open fire or hot spark. It is to be observed however that all of the oil and gas that was burning in the flame prior to the firing of the cannon, while it continues to burn above the non-aerated fuel below the tip, also continues to burn around the outside of the sheath after the cannon is fired until that oil and gas above the tip and outside the sheath is all consumed. It is to be noted that in these circumstances that the fire existing outside of the sheath has now been effectively denied any additional fuel and thus it must and does expire within less than one-half of a second and, further, this fire outside of the sheath cannot flash back because the sheath fully surrounds and guards the flowing oil and/or gas from any contact with this fire. It is also essential to avoid reigniting the oil and gas flow that flows up and out of the well after the sheath becomes discontinuous, by eliminating the potential of sparks or any open flame from any substance or apparatus in the vicinity of the gushing well from contact with that flow before the cannon is fired.

Once the above described substantially instantaneous killing of the flame has been accomplished by the formation of the incombustible sheath or cylinder of fire extinguishing material around it and that ultimately becomes inter-mixed with the flaming oil and gas stream, it has been observed that it takes apparently less than one-hundredth of a second for the sheath to grow and expand to cap the flow as shown in FIG. 8, while the surrounding body of flame is being extinguished through fuel starvation in less than one-half second thereafter. If the fire extinguishing material is selected to be a material that easily absorbs heat, due to the enlarged surface area presented by the exposure of the total surface area of all of the finely divided atomized particles of the fire extinguishing material exposed to the flame, a substantial cooling is produced in any burning products on the periphery of the gushing oil and gas stream 31 and that are confined within the sheath. When this heat is taken away from the flame within the sheath in such a quantity as to substantially cool the flame, the temperature of said flame that is contacted by the fire extinguishing material is lowered to a degree that is below the autoignition temperature for that mixture of materials. Further it is suggested that this effective extinction of the flame in the oil and gas stream can be accelerated if a finely divided extinguisher material can be selected from that group of incombustible materials that is chemically reacted when heated or that is caused to be further decomposed to form incombustible gases or compounds or is otherwise physically transformed by reason of the absorption of heat energy.

Such a preferred form of non-combustible finely divided material having the desired heat absorbing properties that can be used for extinguishing these oil and/or gas well flames can be found in masses of finely divided and separated particles of bicarbonate of soda. In firing charges 24 and 26 of such bicarbonate of soda from the circular series of chambers 21 and 22 of this cannon device as above described, it is important that the explosive charge 28 be selected to be one that will substantially instantaneously drive the particulate material from the muzzles of the chambers of this cannon device, but yet the explosive pressure that must be built up behind the particulate charge must be controlled to preclude too great a pressure being exerted against the bicarbonate of soda particles in the various charges which would cause them to become agglomerated. It has been found that a deflagration type of explosive charge such as common black gun powder is ideally suited for this purpose as distinguished from a detonating type of explosive such as are the well-known substances TNT, RDX, PETN, etc. The gun powder mixture, or whatever explosive is used, should be selected to be one which provides stoichiometric proportions of the combustible components of explosive composition such that, for example, with the gun powder mixture, the oxygen releasing components must be designed so that all of the oxygen released upon the firing of the explosive material must be consumed in the explosive reaction. A quite satisfactory gun powder mixture is sold under trademark PYRODEX.

When the cannon device described above is properly placed in a substantially concentric position around the head of an oil well from which a flaming stream of oil and gas is flowing so the annular array of the muzzles of the chambers surround the periphery of the stream at its base, and the surrounding terrain has been cleared of all burning material which leave red hot ashes or coals, the cannon can be fired.

This apparatus has been used to quench a fire at the head of a small test well having a casing 2" in diameter and a pressure of about 250 lbs./sq. in. from which the oil and gas stream shot out of the casing as a flaming stream of oil and liquid propane 80 feet into the air, the cannon means having one concentric row of chambers as shown in FIG. 2 has been found to be quite adequate. In this instance the chambers 21 were loaded with two 5 lbs. charges 24 and 26 of finely divided bicarbonate of soda ground to have particles within a size range of from about 1 to 20 microns. A charge 28 of about 8 ozs. of the above-mentioned black gun powder, amounting to about 5% of the weight of the fire extinguishing material, was placed between the upper and lower charges of the particulate material in the chambers as is shown in FIG. 4. The upwardly directed muzzles of the rows of chambers 21 projected a sufficiently dense sheath of non-combustible particulate bicarbonate of this material, the leading edge 30 of which was effective, because of its intimate peripheral contact with the flowing stream to extinguish any flame around the upwardly flowing oil and gas stream, to quench the fire immediately at the wellhead in an estimated one-one thousandths of a second as shown in FIG. 5. The upwardly flowing and expanding sheath then grew to completely protect the surface of the upwardly gushing oil and gas stream that followed the tip 30 of the sheath preventing it from being reignited while cutting off the fuel supply of hot gas and boiling and vaporizing oil to the huge body 36 of the surrounding fire as shown in FIG. 6 and 7. It was observed that the flame was substantially instantaneously extinguished as the tip progressed upwardly and the already burning oil and gas 36 above the tip and beyond and surrounding the outside of the upwardly moving and expanding body of the sheath burned itself out in about one-half of a second. The oil and gas which had been fully enclosed in the sheath and totally shut off from the flame body was at too great a distance from any of the remaining vestiges of flame to reignite.

The tip 30 of the sheath of finely divided fire extinguishing material and the following particles in the sheath appears to instantaneously freeze the flame and upon absorbing heat, expand around the flame within the sheath as above explained, and move upwardly and outwardly, finally to become mixed with and form a cap over the top of the stream to insulate the flammable upwardly flowing oil and gas stream from the surrounding atmosphere as shown in FIG. 8 to eliminate its contact with oxygen and thus shutting off the supply of combustible fuel to the huge body 36 of surrounding fire. The sheath produced as above described progressed upwardly along the oil and gas flow at a rate of about 1" per 12/10,000 of a second. Once a significant break in the flame has been created immediately at the top of the wellhead by the tip 30 of the sheath in about one-one thousandths of a second and subsequently when the cooling action produced by the exposure of the particles in the remainder of the body 34 of the sheath by absorption of heat from the flame has set in, there will be no flash-back. Once the propagation of the flame and the possibility of a flash-back has been eliminated it has been observed that the fire was put out in less than about ½ of a second because of the fuel starvation.

The example given above illustrates one set of conditions under which an upwardly flowing stream of flaming oil and gas has been extinguished. In another test a stream of burning oil and liquid propane issuing from a 2" outlet pipe flowing into the atmosphere under a pressure of about 250 lbs. per sq. in. was put out by placing a larger annular cannon means around the upper end of the outlet 20. In this instance the several series of chambers 21 and 22 in the concentric circular pattern were loaded as shown in FIG. 4 with an overkill of 100 lbs. of the above described finely ground bicarbonate of soda charges divided in equal amounts to be fired upwardly and downwardly from these chambers. About 5 lbs. of the black PYRODEX gun powder was equally divided and set between the two charges of the fire extinguishing particles in each of the chambers. When the charges were fired an upwardly directed quickly expanding sheath was produced that extinguished the fire in the immediate vicinity of the oil and gas stream and cut off the fuel supply to the flame 36 by surrounding the flaming oil and gas stream to snuff out the blaze and cool the flame immediately surrounding the oil and gas of the enclosed stream to a temperature below its autoignition temperature in less than fifty-one thousandths of a second.

The combined oxygen shielding action and the heat absorbing actions, performed by the interaction of these finely divided sodium bicarbonate fire extinguishing particles which remove heat from the flowing stream by simple heat exchange and by using some of the heat to cause the fire extinguishing material to be chemically reacted, assist in completion of the elimination of all possibility of any of the flame being present within the sheath and also serve to cool the flow of these combustible products to a temperature below the autoignition point thereof. It must also be observed that the decomposition of the bicarbonate of soda also results in the production of carbon dioxide as one of the products of its decomposition, which $CO_2$ further fills the expanding space and becomes an important part of the sheath disposed around the oil and gas flow to assist in insulating these combustible products from contact with the ambient air. It is to be here noted that any fire extinguishing matter that can be decomposed upon being heated can be used, provided further that any gas produced which tends to smother a fire may be used excepting that poisonous gasses should be avoided for the well being of the fire fighters, unless they wear gas masks.

Once the flame surrounding the flowing stream is so rapidly extinguished, the flame remains extinguished provided the oil and gas stream remains fully shielded by the upwardly expanding transient sheath for at least a fair part of a second, after which reignition by a flashback is impossible. The persistent existence of the sheath for the purpose, of starving the fuel supply to flame 36 eliminates the flashback potential because the body of external fire is too far away from the jetting columns of fuel to cause reignition.

The oil fire fighting cannon shown in FIG. 2 as above explained has been used to snuff out the flame around a flowing oil and gas stream almost instantaneously and, thereafter, the combustible material already in the existing flame 36 outside of the sheath must burn itself out and this flame-out does occur within one half a second. Such results have been recorded by a 1/32 of a second stop motion video study of the firing of a number of sheaths fired from a cannon device around flaming oil and liquid propane streams flowing from an outlet pipe 2" in diameter issuing from two huge tanks of propane at pressures of from 200 lbs./sq. in. to pressures up to 250 lbs. per sq. in.

If a flaming stream is flowing from a wellhead larger than about 5" in diameter, a cannon having more than two concentric rows of chambers may be used; for example, a cannon with four rows of concentrically arranged chambers can be provided. A cannon with four rows of concentrically arranged chambers may have all of the chambers fired off simultaneously, for example, but in a preferred use of this structure the separate rows may be fired in rapid succession to provide a continuous upward flow of the finely divided fire extinguishing particles to in effect double or triple the sheath's life with a longer time duration of the delivery of the fire extinguishing particles around the flame. Such an elongated sheath may be desired for surrounding a larger volume of the flammable oil and gas flow to preclude the accidental reignition of the flow by a flashback. The above-mentioned means for successively simultaneously firing the charges 28 in each of the several three or more rows of the chambers is not shown, but those skilled in the explosive art such as in the timed firing of chambers of explosive gas and air mixtures which are found in the automotive field, for example, can provide the necessary electrical circuitry for accomplishing the desired timed sequential firing order of the successive rows of chambers.

The body of the cannon can be formed of any strong inert material that will be unaffected by the oil and gas or the temperature of the flaming stream. A suitable steel shell 40 may be provided that can be filled with any insulating material 38 such as, for example, a refractory which supports and surrounds the plurality of vertically extending chambers such as the chambers 21 and 22 that contain the charges 26 of the fire extinguishing material and the explosive charges 28. The insulation 38 filled into the shell of the body 10 must protect the explosive charges from being prematurely exploded while the cannon is being moved into position around a flaming stream.

It has been stated above that the preferred fire extinguishing material for forming the sheath that snuffs out the flame is finely ground particles of bicarbonate of soda. It is proposed that any finely divided incombustible material that absorbs heat can be successfully used in this cannon-like device to form a useful coherent sheath around the flowing oil and gas stream provided the sheath is so dense as to be impervious to air. Other such materials that may be atomized to form the desired particles for example may be selected from non-gas forming material such as silica gel, or a flame-poisoning gas-forming product known to the oil well fire extinguishing trade such as mono ammonia phosphate, or a carbamic powder such as is mentioned in col. 2, lines 11 to 29, of the U.S. Pat. No. 4,899,827.

The preferred situation of the cannon relative to the outlet or wellhead 20 is in a position suspended about three feet above the ground level or mounted either on suitable legs or over a deflector 50 as shown in FIG. 5, and it is positioned to be approximately concentric around the upwardly extending end of the oil well liner pipe. It is obvious that if such an extension does not exist, the cannon should be so set up that all of the upwardly spewing oil and gas stream shall issue through the center hole formed by the closing of the element 16 and 18 as shown in FIG. 2. It is important only that all of the flammable material flow in a path that can be surrounded by the two cylindrical sheaths fired the one generally upwardly, and that expands outwardly and the other downwardly from the preferred form of the cannon whereby to extinguish the flaming oil and gas without there being any possibility of incurring a flashback from flaming oil that surrounds the outside of the sheath that is being allowed to burn out naturally.

Figure 1:
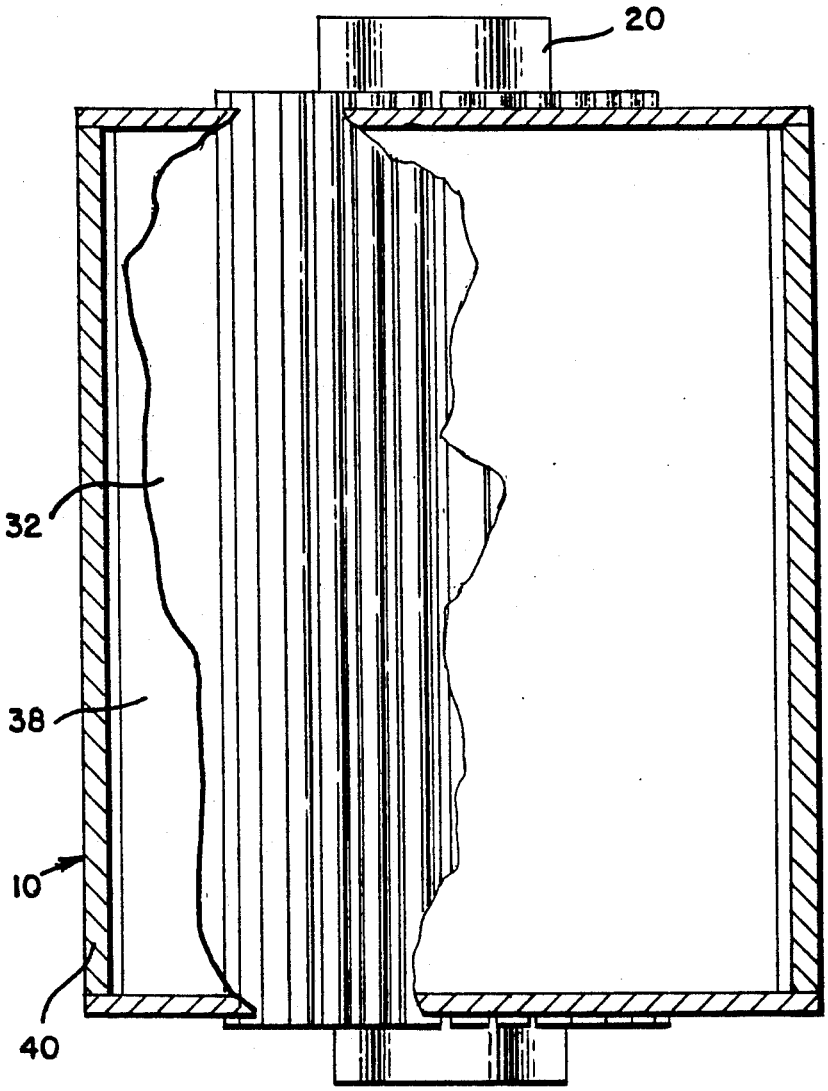
FIG. 1 is a side elevation partly broken away showing the portable cannon-like apparatus positioned around a well head.

In certain instances where there is a possibility that some of the combustion taking place cannot be wholly contained within the coaxis of the cannon as described above, referring to FIG. 5, it may be desirable to utilize an inert deflector 50 under the cannon. Ordinarily it is appropriate to use the cannon spaced about 31 inches above the ground to surround outlet 20 as shown in FIG. 1 where the generally upwardly and downwardly directed particulate charges serve mainly to provide only an equal action and reaction phenomenon, wherein the downwardly issuing charge serves only to provide the reaction force for making the firing of the cannon a smoother process.

It is sometimes necessary to snuff out the fire on the surface of the puddle or pond of oil that surrounds the outlet from the well. When such a fire in a pond or on the ground is encountered, the inert annular bell-shaped deflector is placed on the ground or in the flaming pool with its annular opening surrounding the upwardly flowing oil and gas stream and then the cannon device can be placed immediately over the deflector with its center hole concentrically disposed over the deflector's center hole. The bottom of the deflector will smother the fire below it immediately around the outlet pipe 20 and when the cannon is fired, the downwardly projected particles will be directed over the upper surface of the deflector to be spread outwardly in a substantially horizontal plane to form an inert blanket over the surface of the flaming oil in the pond or on the ground immediately surrounding the well. It is estimated that the loading on the extinguisher material to deflect it 90° will be in excess of 900 Gs. This blanket will be effective to smother the flaming oil on the surface of the pond or ground throughout a more or less circular area about 50′ to 75′ in diameter. Obviously if this pond or ground fire is too widespread it will first have to be reduced or eliminated prior to the use of this cannon device in order to preclude the back firing of the oil and gas stream flowing from the well after the initial freezing of the flame has been accomplished.

While the above description sets forth the best form of this invention as conceived by me and described herein, it is obvious that modifications thereof may occur to those skilled in the art that will fall within the scope of the following claims.

I claim:

1. A method of extinguishing a flaming fire in an elongated stream of oil and gas blowing from an oil well outlet that is positioned at a top of an oil well drilled into ground, said oil and gas stream flowing from said oil well outlet at a velocity consistent with an underground pressure in the well, said stream blowing into surrounding atmospheric air, said flaming fire being a ball having a base adjacent said outlet, said method comprising instantaneously freezing the flaming fire at the base of said ball, and then immediately and progressively enclosing a length of said elongated stream in a sheath that is impervious to said atmospheric air, said sheath progressing along the length of said stream at a velocity greater than the velocity of said stream as it issues from said outlet.

2. A method as in claim 1 wherein the stream is surrounded by said sheath as said stream issues from said outlet, said stream having an outer peripheral surface, and said sheath has a tip end and a growing tubular body that engages said outer peripheral surface of said stream for freezing the flaming fire.

3. A method as in claim 1 wherein said sheath is formed of a dense mass of particulate fire extinguishing material that absorbs heat from said fire.

4. A method as in claim 3 wherein said material is bicarbonate of soda and said absorbed heat decomposes said material.

5. A method as in claim 3 wherein said sheath forms an inert barrier including a cap that grows between said stream and said flaming fire.

6. A method as in claim 1 wherein said sheath encloses said stream while said flaming fire burns out.

7. A method as in claim 1 wherein upon a completion of said enclosing said sheath encloses said oil and gas stream and a cap is formed over said stream whereby to entirely separate the flaming fire from said oil and gas in the stream.

8. A method as in claim 1 wherein said sheath is moved to enclose said stream by an explosive force.

9. A method as in claim 8 wherein said sheath is moved by a deflagration type of explosive charge.

10. A method as in claim 9 wherein said explosive charge is a type of black gun powder.

11. A method as in claim 9 wherein said sheath is formed of particulate bicarbonate of soda that decomposes to produce a carbon dioxide component in said sheath.

12. A method as in claim 9 wherein said sheath has two sections including one section that forms a portion of said sheath that encloses the length of the stream blowing from said well outlet, and another section that forms an additional sheath portion that moves in an opposite direction relative to said one section of said sheath.

13. A method as in claim 12 wherein said additional sheath portion is deflected to move at a right angle away from the stream.

14. A process for extinguishing a flame that surrounds a stream of high pressure oil and gas flaming above a well outlet, said stream having an exposed outer surface 5 said process comprising surrounding said outer surface of said stream with a growing sheath; said sheath having a tip end for first engaging said outer surface starting at said outlet; said tip end moving upwardly along said stream while said sheath is simultaneously expanding sidewise as it moves upwardly along said outer surface; and then subsequently capping said stream.

15. A process as in claim 14 wherein said sheath is formed of a dense mass of particulate fire extinguishing material that absorbs heat from said flame.

16. A process as in claim 15 wherein said material is bicarbonate of soda and said absorbed heat decomposes said material.

17. A process as in claim 16 wherein said sheath is moved to enclose said stream by an explosive force of a type of a black gun powder explosive composition.

18. A process as in claim 15 wherein said sheath is moved to enclose said stream by an explosive force.

19. A process as in claim 14 wherein said tip end of said sheath expands inwardly as said sheath grows whereby to form a cap on said stream that separates said flame from contact with said stream.

20. A device for extinguishing a flame surrounding a burning stream of oil and gas that is escaping from an oil well outlet comprising a body for surrounding the outlet, said body having a plurality of elongated chambers that are disposed about parallel to said burning stream of oil and gas, said elongated chambers each having an open muzzle and said muzzles collectively being disposed in a substantially concentric pattern around said stream, each of said chambers being provided with an explosive charge, a fire extinguishing material disposed in each of said elongated chambers over said explosive charge thereof, and means to simultaneously activate all of said explosive charges in said elongated chambers to drive said fire extinguishing material out of all of the muzzles of said chambers to form a sheath of the fire extinguishing material around said stream of oil and gas.

21. A device as in claim 20 wherein said body is an annulus and includes sections that are hinged together so that the annulus can be opened up to be placed around said outlet and then closed to dispose said chambers in said concentric pattern.

22. A device as in claim 21 wherein each of said sections supports a multiplicity of said chambers.

23. A device as in claim 20 wherein said chambers are separable from said body whereby they may be loaded and stored for future use upon subsequently being assembled together with said body.

24. A cannon device, for placement around an oil and gas stream flowing from a well outlet which oil and gas stream fuels a flame above the outlet, comprising an annular body means constructed and arranged to be placed around said oil and gas stream as said oil and gas stream flows from the outlet, a plurality of elongated chambers supported in said annular body means, each of said elongated chambers being carried by said annular body means to be positioned in general alignment with said stream, said plurality of the elongated chambers also being supported by said annular body means to be disposed in a substantially concentric pattern around said oil and gas stream, each one of said elongated chambers being loaded with an explosive charge, and a fire extinguishing material positioned in each one of said elongated chambers over the explosive charge in the elongated chamber thereof whereby when all of said explosive charges are exploded simultaneously said fire extinguishing material is driven from each of said elongated chambers to collectively form a sheath that grows around said stream which sheath separates said flame from said oil and gas stream.

25. A cannon device, for placement around an oil and gas stream flowing upwardly from an oil well outlet that fuels a flame above said outlet, comprising an annular body means that is constructed and arranged to be placed around said stream as said stream flows from said outlet, and a plurality of elongated chambers supported in said annular body means, said elongated chambers being carried by said annular body means in general alignment with said stream, said elongated chambers having top and bottom ends, said plurality of the elongated chambers being supported by said annular body means in a concentric pattern around said stream, each one of said elongated chambers being loaded with an explosive charge, each one of said explosive charges having a top side and a bottom side, each elongated chamber having means to detonate said explosive charge loaded therein, a pair of masses loaded into each one of said elongated chambers, one of each of said pair of the masses being disposed in one of said elongated chambers on the top side of said explosive charge thereof and the other one of each of said pair of the masses being disposed on the bottom side of said explosive charge thereof, said masses on the top sides of all of said explosive charges being a fire extinguishing material, means to fire all of said explosive charges simultaneously for producing a driving force to drive said fire extinguishing material from said elongated chambers to form a sheath that grows around said oil and gas stream, and the other one of said plurality of the masses disposed on the bottom sides of all of said explosive charges being operative to produce a reaction force to balance the driving force behind said fire extinguishing material which driving force is generated upon detonation of said explosive charges to drive all of said masses from said elongated chambers.

26. A cannon device as in claim 25 wherein both of said masses are identical fire extinguishing material.

27. A cannon device as in claim 26 wherein said other one of said masses is deflected outwardly at a right angle to an upwardly direction of said oil and gas stream.

28. A method for extinguishing a flaming fire in a flowing stream of oil and gas blowing from an outlet of an oil well into atmospheric air at a velocity consistent with an underground pressure in said oil well, said method comprising moving a cylindrical body of fire extinguishing material into position to surround said oil and gas stream at said outlet, said cylindrical body of the extinguishing material moving at a faster velocity than the velocity of said oil and gas stream to instantaneously freeze the flaming fire in the oil and gas stream adjacent said outlet, and said moving cylindrical body continuing movement thereof to be in a position to enclose the oil and gas stream in a sheath that is impervious to the air.

29. A method for instantaneously extinguishing a flaming fire surrounding an uncontrolled stream of oil and gas blowing from an oil and gas well outlet into atmospheric air that surrounds said outlet, said flaming fire being sustained by being fed from said uncontrolled stream at a high velocity from said outlet of an oil well drilled into ground, said uncontrolled stream being initially defined by a peripheral wall at the outlet of the well, said method comprising sealing the peripheral wall of said oil and gas stream adjacent said outlet from contact with the atmospheric air immediately adjacent said outlet with a fire extinguishing substance, and driving said fire extinguishing substance away from said outlet of the well at a faster velocity than the velocity of said oil and gas stream to form a sheath of said fire extinguishing substance around said peripheral wall of said oil and gas stream to seal said blowing stream from said well outlet from contact with said atmospheric air.

30. A method for extinguishing flames that surround and are fed by an elongated stream of oil and gas, said stream issuing under pressure from an outlet of an oil well drilled into ground, said outlet being surrounded by atmospheric air, said stream issuing from said outlet at a velocity consistent with a pressure within said well, said stream blowing into said surrounding atmospheric air, said method comprising substantially instantaneously delivering a mass of a fire extinguishing material in a position to surround said stream as said blowing oil and gas stream issues from said outlet, said mass of the fire extinguishing material moving upwardly along said stream at a velocity greater than the velocity of said stream as said stream issues from said outlet to form a sheath that surrounds said stream, said extinguishing material being a composition that expands upon being heated so that said sheath expands outwardly as said sheath moves upwardly along said blowing stream, said sheath being impervious to the air to suffocate any flames within said sheath and serving to separate said stream from contact with said atmospheric air, and said sheath moving upwardly and expanding outwardly around said oil and gas stream for a period of time sufficient to starve the flames that are external to said sheath from contact with said oil and gas stream for a time period sufficient to permit said flames external to said sheath to burn out.

31. A method as in claim 30 wherein said time period lasts for one-half of a second.

* * * * *